US011072461B2

(12) United States Patent
Gonitianer et al.

(10) Patent No.: US 11,072,461 B2
(45) Date of Patent: Jul. 27, 2021

(54) STACKABLE SYSTEM CONTAINER

(71) Applicant: BS Systems GmbH & Co. KG, Zusmarshausen (DE)

(72) Inventors: Reiner Gonitianer, Dillingen (DE); Jan Kögel, Zusmarshausen (DE); Paul Elterlein, Augsburg (DE); Tomislav Ravlic, Neusäß (DE)

(73) Assignee: BS SYSTEMS GMBH & CO. KG, Zusmarshausen (DE)

( * ) Notice: Subject to any disclaimer, the term of this patent is extended or adjusted under 35 U.S.C. 154(b) by 3 days.

(21) Appl. No.: 16/317,234

(22) PCT Filed: Apr. 11, 2017

(86) PCT No.: PCT/EP2017/058668
§ 371 (c)(1),
(2) Date: Jan. 11, 2019

(87) PCT Pub. No.: WO2018/010858
PCT Pub. Date: Jan. 18, 2018

(65) Prior Publication Data

US 2019/0308772 A1 Oct. 10, 2019

(30) Foreign Application Priority Data

Jul. 13, 2016 (DE) ..... 10 2016 112 855.4

(51) Int. Cl.
*B65D 21/032* (2006.01)
*B65D 21/02* (2006.01)
*B25H 3/02* (2006.01)

(52) U.S. Cl.
CPC ..... *B65D 21/0228* (2013.01); *B25H 3/02* (2013.01)

(58) Field of Classification Search
CPC ..... B25H 3/02; B25H 3/021; B25H 3/022; B65D 21/0217; B65D 21/0222;
(Continued)

(56) References Cited

U.S. PATENT DOCUMENTS 4,643,494 A 2/1987 Marleau
4,671,943 A 6/1987 Wahlquist
(Continued)

FOREIGN PATENT DOCUMENTS

DE 7244356 U 5/1974
DE 4009960 A1 10/1990
(Continued)

OTHER PUBLICATIONS

International Search Report, Written Opinion and International Preliminary Report on Patentability for PCT/EP2018/064742, filed Jun. 5, 2018.
(Continued)

*Primary Examiner* — Stephen J Castellano
(74) *Attorney, Agent, or Firm* — Paul D. Bianco; Stephen Bongini; Fleit Intellectual Property Law

(57) ABSTRACT

A stackable system container having a base part, with a respective coupling device for connection to a further system container fastened on two opposite side walls of the base part such that it can be moved between a rest position, in which the coupling device can be disengaged from a further system container, and a coupling position, in which the coupling device can be engaged with the further system container. In order to provide for structurally identical system containers to be stacked optionally in a dimensionally stable, interconnected manner or separately, and therefore such that they can easily be singulated, each coupling device is assigned a locking element, which locks the respective coupling device releasably in the rest position.

11 Claims, 8 Drawing Sheets

(58) Field of Classification Search
CPC ..... B65D 21/0223; B65D 21/023; B65D 21/0228; B65D 21/0209; B65D 21/0212; B65D 21/0215; B65D 21/0219; B65D 21/022
See application file for complete search history.

(56) References Cited

U.S. PATENT DOCUMENTS

| | | | |
|---|---|---|---|
| D292,634 | S | 11/1987 | Chabot |
| 4,820,499 | A | 4/1989 | Taschner |
| 5,101,969 | A | 4/1992 | Umiker |
| D340,353 | S | 10/1993 | Benarrouch |
| 5,379,887 | A | 1/1995 | Conley, Jr. |
| D355,764 | S | 2/1995 | Apps |
| D356,211 | S | 3/1995 | Apps |
| D356,679 | S | 3/1995 | Apps |
| D360,757 | S | 8/1995 | Snetting |
| D361,663 | S | 8/1995 | Kalin |
| 5,445,273 | A | 8/1995 | Apps |
| 5,495,945 | A | 3/1996 | Apps |
| 5,890,613 | A | 4/1999 | Williams |
| D416,682 | S | 11/1999 | Tanji |
| 5,979,654 | A | 11/1999 | Apps |
| 6,082,539 | A | 7/2000 | Lee |
| D439,408 | S | 3/2001 | Gibson |
| D446,015 | S | 8/2001 | Apps |
| D448,567 | S | 10/2001 | Buss |
| D452,613 | S | 1/2002 | Hammett |
| D462,522 | S | 9/2002 | Apps |
| D470,658 | S | 2/2003 | Chunn |
| D478,421 | S | 8/2003 | Overholt et al. |
| D483,946 | S | 12/2003 | Koefelda |
| D487,634 | S | 3/2004 | Apps et al. |
| 6,874,634 | B2 | 4/2005 | Riley |
| 6,880,869 | B2 | 4/2005 | Schainholz |
| 6,889,838 | B2 | 5/2005 | Meier et al. |
| 7,000,287 | B2 | 2/2006 | Valentini |
| D520,237 | S | 5/2006 | Cheng |
| D520,734 | S | 5/2006 | Henning et al. |
| D524,651 | S | 7/2006 | Perret |
| D539,541 | S | 4/2007 | Stahl |
| D542,529 | S | 5/2007 | Peart et al. |
| D557,011 | S | 12/2007 | Fernandez et al. |
| D572,479 | S | 7/2008 | Buck |
| D595,958 | S | 7/2009 | Twig |
| D598,684 | S | 8/2009 | Stahl |
| 7,573,385 | B2 | 8/2009 | Tonelli |
| D600,015 | S | 9/2009 | Wenchel |
| D601,797 | S | 10/2009 | Wenchel |
| D608,094 | S | 1/2010 | Concari |
| D616,200 | S | 5/2010 | Riedel et al. |
| D620,255 | S | 7/2010 | Chang |
| D630,435 | S | 1/2011 | Brunner |
| 8,061,492 | B2 | 11/2011 | Riedel et al. |
| 8,186,534 | B2 | 5/2012 | Apps |
| D668,867 | S | 10/2012 | Yamamot |
| D688,869 | S | 9/2013 | Lindstrom |
| 8,522,967 | B2 | 9/2013 | Lindstrom |
| 8,590,704 | B2 | 11/2013 | Koenig et al. |
| 8,677,661 | B2 | 3/2014 | Michels et al. |
| D704,442 | S | 5/2014 | Chen |
| D719,352 | S | 12/2014 | Shitrit |
| D738,106 | S | 9/2015 | Shitrit |
| 9,131,770 | B2 | 9/2015 | Stegherr |
| D750,890 | S | 3/2016 | Quehl |
| D757,435 | S | 5/2016 | Damberg |
| D759,975 | S | 6/2016 | Zozin |
| D785,938 | S | 5/2017 | Ou |
| D790,221 | S | 6/2017 | Yahav |
| D792,708 | S | 7/2017 | Tazawa |
| D798,053 | S | 9/2017 | Shitrit |
| D801,685 | S | 11/2017 | Meng |
| D808,653 | S | 1/2018 | Rayeski |
| D811,084 | S | 2/2018 | Ballou |
| RE47,022 | E | 9/2018 | Sosnovsky et al. |
| D833,743 | S | 11/2018 | Tonelli |
| D841,981 | S | 3/2019 | Kogel |
| D841,982 | S | 3/2019 | Kogel |
| D841,983 | S | 3/2019 | Wang |
| 10,405,626 | B2 | 9/2019 | Gonitianer et al. |
| D872,471 | S | 1/2020 | Zhao |
| D873,004 | S | 1/2020 | Shpitzer |
| D882,952 | S | 5/2020 | Austin |
| 10,703,534 | B2 | 6/2020 | Brunner |
| 10,710,770 | B2 | 7/2020 | Kogel |
| 10,829,269 | B2 | 11/2020 | Gonitianer et al. |
| 10,870,513 | B2 | 12/2020 | Gonitianer |
| 2003/0094392 | A1 | 5/2003 | Meier et al. |
| 2003/0102970 | A1 | 6/2003 | Creel et al. |
| 2006/0049640 | A1 | 3/2006 | Lee |
| 2006/0170558 | A1 | 8/2006 | Tonelli |
| 2008/0067091 | A1 | 3/2008 | Chang |
| 2008/0251396 | A1 | 10/2008 | Oh |
| 2009/0236255 | A1 | 9/2009 | Piacenza et al. |
| 2011/0121695 | A1 | 5/2011 | Purdy |
| 2011/0139666 | A1 | 6/2011 | Sosnovsky et al. |
| 2011/0147256 | A1 | 6/2011 | Atherton et al. |
| 2011/0186397 | A1 | 8/2011 | Sheikh |
| 2011/0233096 | A1 | 9/2011 | Michels et al. |
| 2014/0062281 | A1 | 3/2014 | Stegherr |
| 2014/0262885 | A1 | 9/2014 | Green et al. |
| 2016/0008972 | A1* | 1/2016 | Chen ..... B25H 3/023 206/373 |
| 2016/0144500 | A1 | 5/2016 | Chen |
| 2016/0213115 | A1 | 7/2016 | Gonitianer et al. |
| 2017/0318927 | A1 | 11/2017 | Kraus et al. |
| 2018/0220758 | A1 | 8/2018 | Burchia |
| 2019/0291922 | A1 | 9/2019 | Gonitianer |
| 2019/0308772 | A1 | 10/2019 | Gonitianer |
| 2019/0315515 | A1 | 10/2019 | Gonitianer et al. |
| 2020/0346819 | A1 | 11/2020 | Kögel |

FOREIGN PATENT DOCUMENTS

| | | | |
|---|---|---|---|
| DE | 4107267 | A1 | 9/1992 |
| DE | 9314298 | U1 | 2/1994 |
| DE | 29723812 | U1 | 4/1999 |
| DE | 102006002475 | | 7/2006 |
| DE | 202005015040 | | 8/2006 |
| DE | 10 2007 032382 | A1 | 1/2008 |
| DE | 202012102760 | U1 | 12/2012 |
| DE | 10 2011 110207 | A1 | 2/2013 |
| DE | 20 2013 003741 | U1 | 4/2013 |
| DE | 202014101556 | U1 | 7/2014 |
| DE | 20 2014 103695 | U1 | 10/2014 |
| DE | 10 2013 110496 | A1 | 3/2015 |
| DE | 102013110496 | | 3/2015 |
| DE | 20 2015 005752 | U1 | 11/2016 |
| DE | 202015005752 | | 12/2016 |
| DE | 10 2016 112853 | A1 | 1/2018 |
| EP | 0555533 | A1 | 8/1993 |
| EP | 0997234 | A1 | 5/2000 |
| EP | 1238602 | A2 | 9/2002 |
| EP | 1516703 | A1 | 3/2005 |
| EP | 2020188 | A1 | 2/2009 |
| EP | 2703310 | A1 | 3/2014 |
| GB | 2459288 | | 10/2009 |
| WO | 01/25701 | | 4/2001 |
| WO | 02/11955 | A1 | 2/2002 |
| WO | 2011/000387 | A1 | 1/2011 |
| WO | 2011/032568 | | 3/2011 |
| WO | 2016/091570 | A1 | 6/2016 |
| WO | 2017/001083 | A1 | 1/2017 |
| WO | 2018/10857 | A1 | 1/2018 |
| WO | 2018/10859 | A1 | 1/2018 |

OTHER PUBLICATIONS

Result of Examination Report for German Application No. 10 2017 128 493.1, filed Nov. 30, 2017.

International Search Report and Written Opinion for PCT/EP2017/058672 filed Apr. 11, 2017.

(56) References Cited

OTHER PUBLICATIONS

Result of Examination Report for DE 10 2016 112 853.8, filed Jul. 13, 2016.
International Search Report and Written Opinion for PCT/EP2017/058667 filed Apr. 11, 2017.
Result of Examination Report for DE 10 2016 112 854.6, filed Jul. 13, 2016.
International Search Report and Written Opinion for PCT/EP2017/058668 filed Apr. 11, 2017.
Result of Examination Report for DE 10 2016 112 855.4, filed Jul. 13, 2016.
Response to Office Action filed Jul. 15, 2020 for U.S. Appl. No. 16/317,175, filed Jan. 11, 2019.
Office Action for U.S. Appl. No. 16/317,188, dated Mar. 18, 2020.
Office Action dated Apr. 16, 2020, for U.S. Appl. No. 16/317,175.
Youtube, XL-Boxx—The large power tool and transport case in the L-Boxx System posted by user Alexander Schweyer on Oct. 7, 2019 (https://ww.youtube.com/watch?v=A3gakVZn_y!) 2019.
Home Depot, 6"H × 14"W × 17.5"L Compartment Small Part Organizer first reviewed on Apr. 2, 2012 2012.
Office Action dated Jul. 20, 2020, for Design U.S. Appl. No. 29/679,432.
For U.S. Appl. No. 16/317,188: Response dated Jun. 1, 2020 Final Office Action dated Jun. 29, 2020.
Notice of Allowance dated Sep. 22, 2020 for U.S. Appl. No. 16/317,175.
Notice of Allowance dated Sep. 22, 2020 for U.S. Appl. No. 16/317,188.
English translation of International Preliminary Examination Report for PCTEP17/058667, filed Apr. 11, 2017.
English translation of International Preliminary Examination Report for PCT/EP17/058668, filed Apr. 11, 2017.
International Preliminary Examination Report with English translation of Written Opinion for PCT/EP17/058672, filed Apr. 11, 2017.
Result of examination report for German Application No. 10 2013 110 496.7, filed Sep. 23, 2013.
Result of examination report of German Application No. 10 2017 117 823.6, filed Aug. 7, 2017.
International Search Report, Written Opinion and International Preliminary Report on Patentability for PCT/EP2014/068714, filed Mar 26, 2015.
For U.S. Appl. No. 16/317,188: Reply to Office Action dated Sep. 14, 2020.
For U.S. Appl. No. 29/679,432: Response filed Nov. 19, 2020 Final Office Action dated Dec. 2, 2020.

* cited by examiner

STACKABLE SYSTEM CONTAINER

This application is the national stage (Rule 371) of international application No. PCT/EP2017/058668 filed Apr. 11, 2017.

FIELD OF THE INVENTION

The invention concerns a stackable system container.

BACKGROUND OF THE INVENTION

A stackable system container is known from DE 10 2013 110 496 having a bottom part with an upward-facing open storage space and a cover part bordering the storage space on top and attached to pivot on the bottom part. The system container also has coupling devices movably fastened to opposite side walls of the bottom part, which serve for coupling of the system container with further system containers and therefore permit secure stacking of such system containers. The coupling devices are designed movable between a rest position in which the coupling devices disengage from the further system container and a coupling position in which the coupling devices can be engaged with the further system container and are laid out to retentively cooperate having corresponding coupling elements protruding upward above the top of the system container or cover part of an equivalent container arranged underneath. The coupling elements are an integral component of the corresponding bottom part and each includes at least one latch for locking of the coupling device. The coupling elements are also arranged on opposite ends of the top of the system container and permit centering, positioning and stacking of several such system containers one atop the other. After they have been aligned, several system containers can be connected in a dimensionally stable but releasable manner using the coupling devices and the coupling elements. In order to achieve the simple and rapid connection of system containers, the coupling devices are biased, for example, via a spring element in a coupling position so that the coupling devices are automatically connected to the coupling elements of further system containers as soon as they are brought together with sufficient pressure. This shape-mated and force-fit connection permits comfortable carrying of several system containers joined to one another in one hand. A shortcoming here, however, is that in logistics during transport the system containers must be quickly and easily separable in large stacks, and automatic connection of system containers with one another is therefore a shortcoming.

SUMMARY OF THE INVENTION

An aspect of the disclosure relates to a stackable system container that permits stacking of identical system containers, in which the stack is connected in a dimensionally stable manner or separately and is therefore easily singulated.

Advantageous embodiments are also disclosed.

The stackable system container according to the invention is characterized by the fact that each coupling device is assigned a locking element that locks the corresponding coupling device releasably in the rest position. Because of this it can be prevented particularly simply such that identical system containers stacked one atop the other are connected to one another, which permits simpler and precise handling in logistics. In addition, the end customer can also freely select whether or not the system containers are to be automatically connected in the stack.

Identical or equivalent system containers are understood to mean containers that are designed to cooperate retentively using two coupling devices of the system containers, in which different embodiments are also included with reference to dimensions or the presence of additional elements.

In particular, the system containers can advantageously include spring elements that force the coupling devices into the coupling position, which permits independent connection of several identical system containers. Without the locking elements these system containers, however, during stacking and logistics and also with the end customers, would also be firmly joined to one another automatically without the need for further handling, which leads to significant time delays when the system containers are to be singulated again.

Such a locking element can be designed, for example, as a slide, which in a locking position keeps the corresponding coupling device in the rest position in shape-mated manner. The slide can then be fastened movably to the bottom part of the system container or to the coupling device itself. The slide can then be brought into engagement with the coupling device or the bottom part in the rest position by means of a translatory movement so that the corresponding coupling device is locked in the rest position relative to the bottom part.

As an alternative, the locking element can also be designed as a knob that in the locking position keeps the corresponding coupling device in the rest position in shape-mated manner. By rotating the knob, the coupling device can be simply and securely locked in the rest position and also released from the rest position. For particularly stable locking of the coupling devices in the rest position, at least one snap-in tab can be provided on the opposite side walls, which can be engaged using the corresponding locking element in the locking position. Each coupling device can be releasably locked in the rest position in a shape-mated manner using the corresponding locking element.

With particular preference, the coupling devices are fastened to the side walls to pivot between a pivoted-in rest position and a pivoted-out coupling position so that simple storage and handling of the coupling devices are obtained. Simple connection of several identical system containers is also achieved by the fact that each coupling device can be pivoted around a parallel, specifically horizontal, pivot axis relative to the side walls.

In order to arrange the coupling devices in the rest position in a space-saving manner and also protect them from damage, the opposite side walls can each have a recess in which the coupling devices are arranged, specifically in the rest position.

In a preferred embodiment, coupling elements can be arranged on the bottom part or cover part of the system container protruding upward beyond the top of the cover part, which are designed to cooperate with the coupling devices of an identical system container arranged above it. The coupling elements serve to position and fix a further container on top of the cover part and can be designed, for example, as an undercut, protrusion or recess that permits shape-mated connection with a further system container.

With particular preference, a counter-element corresponding to the coupling element is provided on the coupling devices in a coupling position beneath each coupling element, which is designed for retentive cooperation with an equivalent coupling element of a further system container arranged underneath, for example, as a hook-like protrusion.

A particularly stable shape-mated connection between two such system containers stacked uniformly aligned one above the other is achieved on this account.

Instead of a slide or knob, the locking element can also be designed as a snap-in device between the coupling device and the bottom part. Such a snap-in device can be formed, for example, by a locking ball, which engages in the rest position of the coupling device in a corresponding locking groove in a shape-mated manner and can be overcome by means of a defined force. This can prevent the coupling device from being inadvertently released from the rest position. A corresponding locking element, however, can also be formed using an alternative spring element that does not force the coupling device in the direction of the rest position but merely produces locking in the rest position, for example, by engagement in a groove. The locking element designed as a locking ball or spring element can then also releasably lock the coupling device in the coupling position by means of corresponding locking grooves.

Additional details and advantages of the invention are apparent from the following description of preferred practical examples with reference to the drawings. In the drawings:

DETAILED DESCRIPTION OF THE INVENTION

Figure 1:
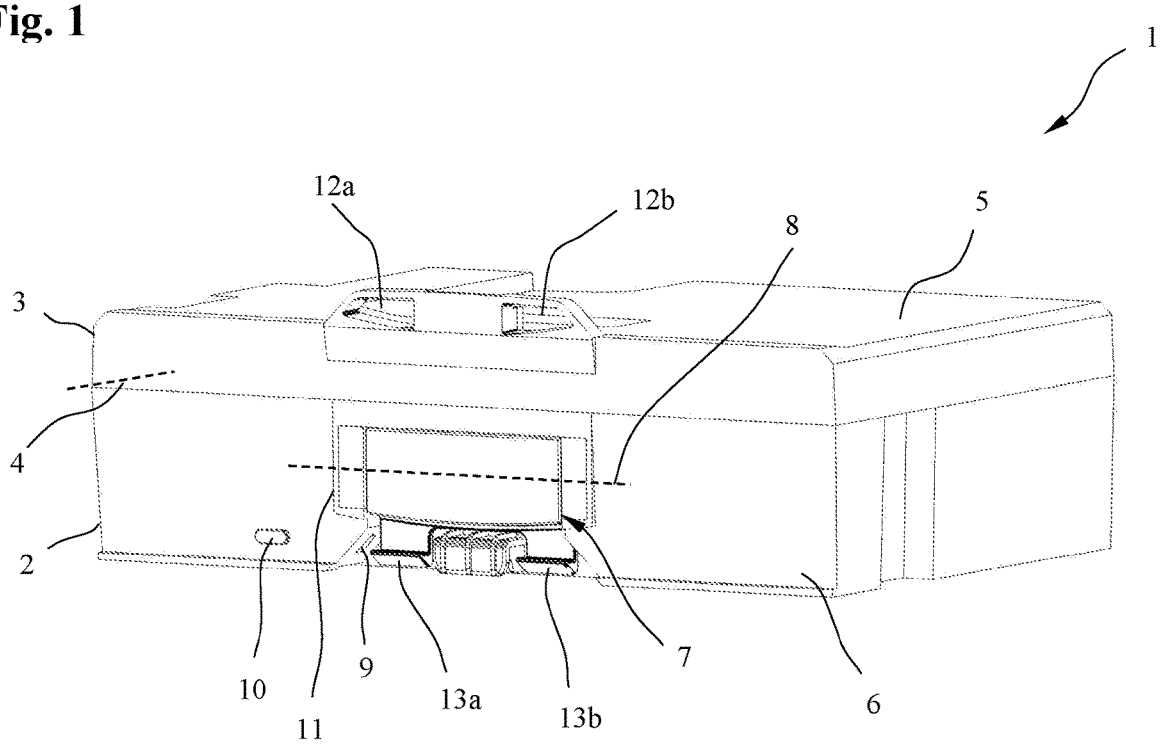
FIG. 1 shows a perspective view of a stackable system container having a coupling device arranged laterally in a coupling position and a locking element.

A perspective view of a stackable system container 1 is shown from the side in FIG. 1. The system container 1 includes a lower bottom part 2 and an upper cover part 3 fastened to pivot on the bottom part 2. The bottom part 2 has an upward-facing open storage space (not shown), which is bounded on the top by the cover part 3. The cover part 3 is connected to the bottom part 2 pivotably via a pivot 4 schematically depicted on the back of the cover part 3. In order to fasten the cover part 3 releasably to the bottom part 2 and securely close the storage space enclosed with it, two closure devices (not shown) are provided on the front of the system container 1 that articulate with the cover part 3 and cooperate retentively with the bottom part 2 in a closed position of the cover part 3.

The system container 1 can be used, for example, by craftsmen in the transport and storage of tools and work materials. For this purpose, the bottom part 2 preferably has a bottom section and four side walls that delimit a storage space that only opens upward. However, it is also possible to design the bottom part like the container disclosed in EP 2 703 310. In this respect, reference is made to EP 2 703 310, and its contents are hereby included in this application.

For simple transport of the system container, 1 a handle (not shown) is arranged on the front of the system container 1 that is formed by the bottom part 2 and the cover part 3. In addition, a retaining clamp can also be fastened on top 5 of the cover part 3 pivotable between an upward protruding position and a pivoted-in position. This retaining clamp in the pivoted-in position can be arranged in a handle recess of the cover part 3 so that the additional retaining clamp forms with the cover part 3 the stepless flat top 5 of the system container 1.

The coupling device 7 is fastened to pivot on one of the side walls 6 of the bottom part 2. A further coupling device designed as a mirror image of the coupling device 7 is also provided on the side wall of the bottom part 2 opposite the side wall 6. The features described with reference to this coupling device 7 are therefore also present in the opposite coupling device.

The coupling device 7 is fastened to pivot around a schematically depicted pivot axis 8 on the side wall 6 between a pivoted-out coupling position depicted in FIG. 1 and a pivoted-in rest position. The pivot axis 8 is formed parallel to the side wall 6 and horizontal. The coupling device 7 is forced into the depicted coupling position by means of a spring element (not shown), so that automatic connection of the system container 1 with further identical system containers is achieved during stacking.

To accommodate the coupling device 7, especially in the pivoted-in rest position, the side wall 7 has a recess 11. The recess 11 can also be dimensioned so that the coupling device 7 does not protrude outward beyond the side wall 6 in the recess 11 in the pivoted-out coupling position depicted in FIG. 1. The coupling device 7 can be arranged in a space-saving manner on this account and thus protected from damage.

Moreover, the coupling device 7 is assigned a locking element 9, which is designed as a slide and is mounted to move in a recess in the bottom part 2. The locking element 9 has a handle section 10 protruding from the side wall 6, which can be grasped from the outside for operation of the locking element 9. By means of a locking element 9, the coupling device 7, which can be held in a shape-mated manner in the rest position and therefore locked, is explained in detail with reference to the following figures.

The upward protruding coupling elements 12*a*, 12*b* are also arranged on the cover part 3 of the system container 1, which are designed to cooperate retentively with the coupling device 7 of an identical system container arranged above it. The coupling elements 12*a*, 12*b* are designed in the depicted practical examples as recesses formed in a locking landing protruding upward above the top 5 of the cover part 3. For retentive connection, the coupling device 7 has a corresponding counter-element 13*a*, 13*b* on the system container 1, as does the identical system container arranged above it (not shown) in the vertical direction beneath each coupling element 12*a*, 12*b*. The counter-elements 13*a*, 13*b* are designed for retentive cooperation with the coupling elements 12*a*, 12*b* by means of corresponding geometry. In the depicted practical examples, the counter-elements 13*a*, 13*b* are designed as hook-like protrusions for retentive engagement in the coupling elements 12*a*, 12*b* configured as recesses.

As in the coupling device 7, the corresponding locking element and the coupling elements are designed in a mirror image manner on the side wall of the bottom part 2 opposite the side wall 6 so that two identical devices for mutual connection of several identical system containers are arranged on opposite side walls. A particularly stable coupling of the system containers that is simply accessible via the side walls and is therefore releasable is obtained on this account, in which, because of the good accessibility, coupling of individual system containers can be deliberately released, especially in a stack of several identical system containers.

Figure 2:
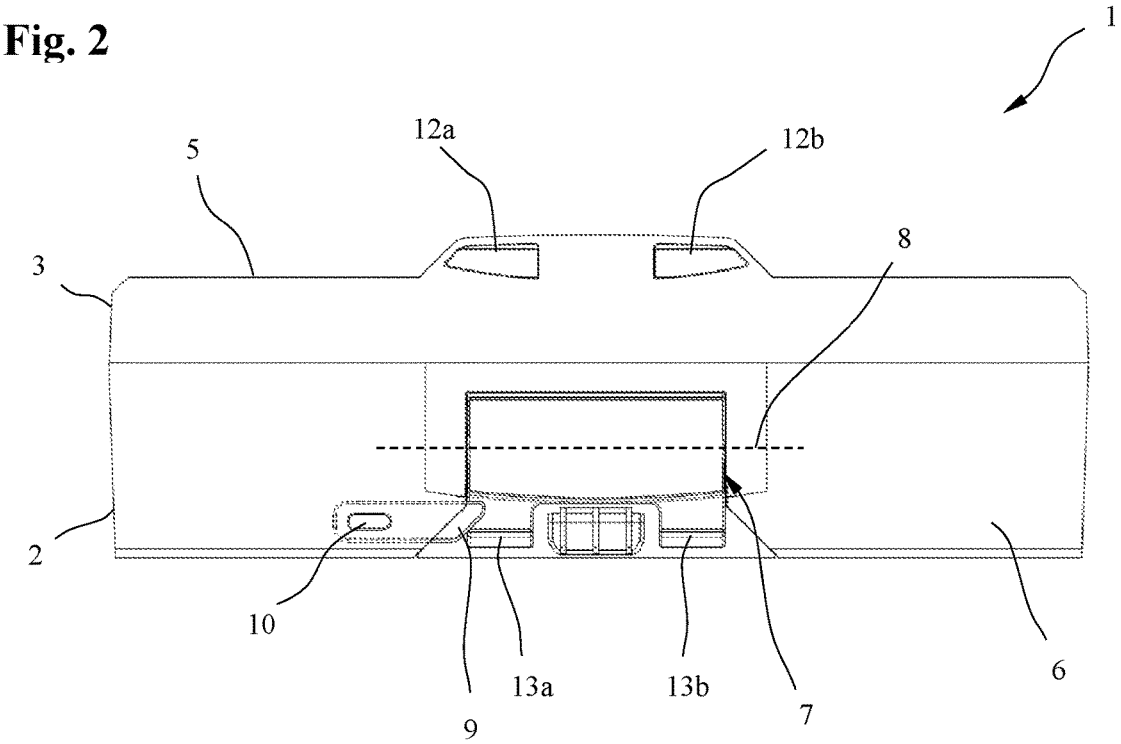
FIG. 2 shows a side view of the stackable system container of FIG. 1, in which the coupling device is locked in the rest position by means of the locking element.

The side view of the stackable system container in FIG. 1 is shown in FIG. 2, in which, in contrast to FIG. 1, the coupling device 7 is arranged in the pivoted-in position and is locked by means of the locking element 9. The locking element 9 here is situated in an extended locking position, which can be achieved, for example, by manual operation of the handle section 10. In this locking position, the locking element 9 protrudes into the recess 11 so that it lies against the coupling device 7 in the rest position and therefore prevents movement of the coupling device 7 in the direction of the pivoted-out coupling position in a shape-mated manner.

A further spring element that forces the locking element from the locking position can also be provided in an embodiment (not shown). In the depicted locking position, the locking element is held by acting laterally against the coupling device by friction and/or also in a shape-mated manner by additional elements. However, as soon as the large-area and simple to operate coupling device 7 is moved away slightly from the locking element 9, i.e., pivoted further in the direction from the coupling position to the rest position, the locking element 9 is automatically moved away from the locking position by the further spring element so that the coupling device is released. Simple release of the coupling device from the rest position can therefore occur using only a single action.

Figure 3:
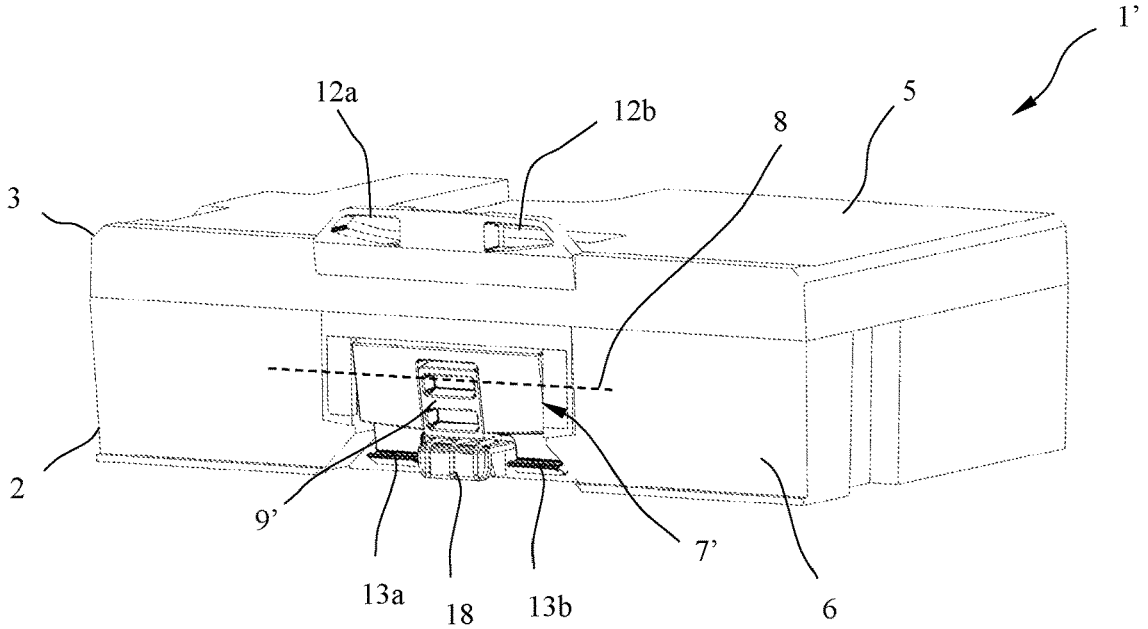
FIG. 3 shows a perspective view of the stackable system container of FIG. 1 in which a coupling device is locked in the rest position by means of a first alternative locking element.

A perspective view of a first alternative embodiment of the stackable system container 1' of FIG. 1 is shown in FIG. 3, in which a coupling device 7' is locked in the rest position by means of a first alternative locking element 9'. The first alternative locking element 9' is designed, like the locking element 9 of the embodiment just described, as a slide, and in contrast to this the locking element 9' is fastened movably to the coupling device 7'. The coupling device 7' can also be releasably locked in the depicted rest position by means of the locking element 9'. Identical features are provided below using the same reference numbers.

Figure 4:
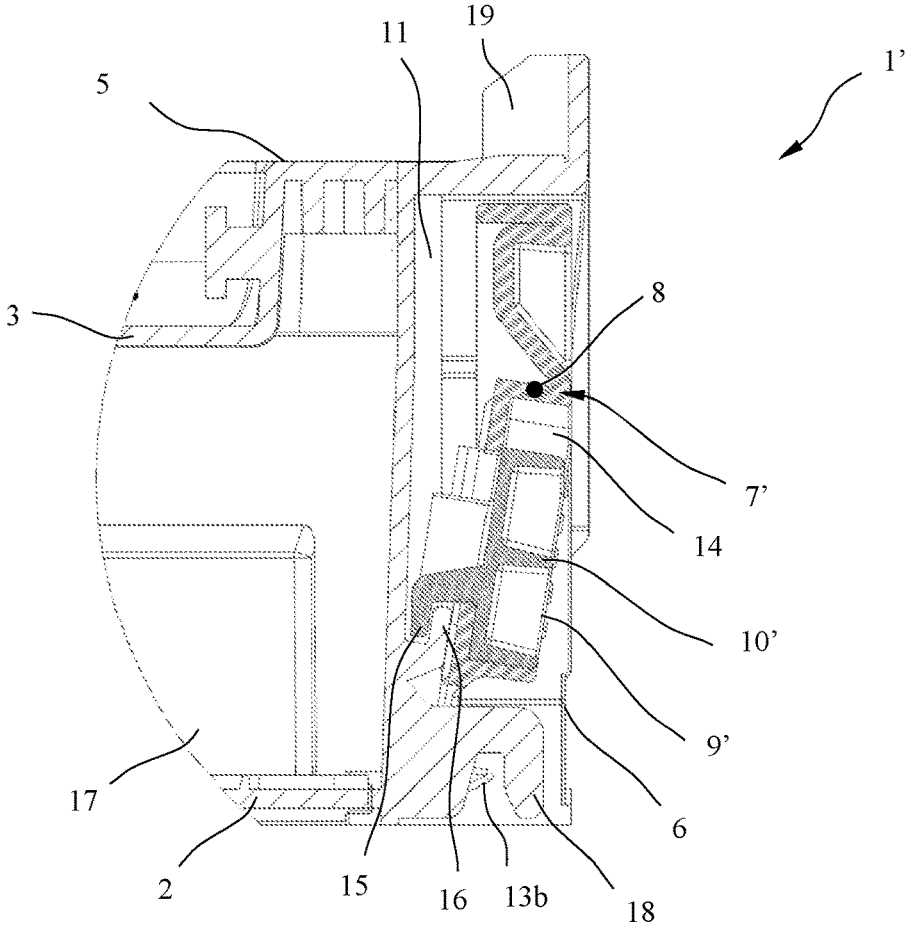
FIG. 4 shows a detail view of a section through the area of the coupling device of FIG. 3.

A detail view of the section through the area of the coupling device 7' of FIG. 3 is shown in FIG. 4. As can be seen, the coupling device 7' is arranged in the pivoted-in rest position, in which the counter-elements 13*a*, 13*b* are pivoted into the recess 11 from the side wall 6. The locking element 9' designed as a slide is arranged in a continuous recess 14 in the coupling device 7' and has a handle section 10' with several retaining ribs on the outside directed toward the side wall 6. On a back side opposite the outside, a hook-like element 15 is provided with a locking element 9', which retentively engages behind a snap-in tab 16 arranged on the bottom part 2 and especially in the recess 11 in the depicted locking position of locking element 9' and therefore keeps the coupling device 7' in the rest position in a shape-mated manner.

As can be seen from FIG. 4, the side wall 6 with the recess 11 has a closed flat wall in the direction of an internal space 17 of the bottom part 2 so that the internal space 17 forms a storage space with straight side surfaces. In addition, the bottom part 2 has a vertical positioning pin 18, which is arranged between the counter-elements 13*a*, 13*b* of the coupling device 7' and is designed to engage on the cover part 3 in a positioning receptacle 19 arranged between the coupling elements 12*a*, 12*b*. In the vertical direction, the positioning pin 18 and the positioning receptacle 19 are arranged precisely one beneath the other so that in a stack of identical system containers, the positioning pin 18 of an upper system container can protrude into the positioning receptacle of a lower container for mutual positioning of the system containers.

Figure 5:
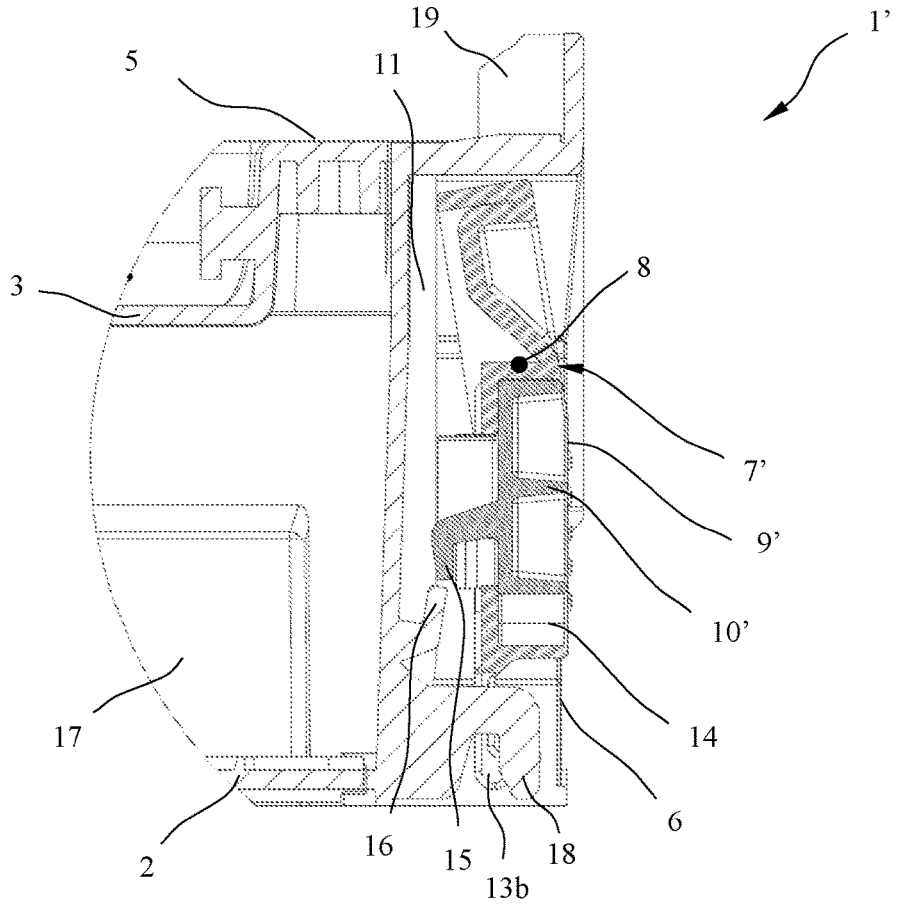
FIG. 5 shows a detail view of a section through the area of the coupling device of FIG. 3 with the coupling device in the coupling position.

A detailed view of a section through the area of the coupling device 7' is shown in FIG. 5, in which the coupling device 7' is in the pivoted-out coupling position. The locking element 9' is then moved into an upper opening positioning from the lower locking position depicted in FIG. 4, which is made simply possible, for example, using the handle section 10'. In the depicted position, the hook-like element 15 no longer engages behind the snap-in tab 16 on the locking element 9' on the bottom part so that the coupling device 7' together with the locking element 9' is forced into the coupling position supported by the spring element (not shown). In the coupling position, the counter-elements 13*a*, 13*b* are arranged in the direction from the recess and toward the side surface 6 so that they can retentively protrude into the corresponding coupling elements 12*a*, 12*b* of an identical system container arranged underneath.

A further spring element can also be provided between the locking element 9' and the coupling device 7', which biases the locking element 9' in the locking position or opening position so that automatic opening or locking is made possible alternately during operation of the coupling device 7', if automatic displacement occurs during mutual contact by means of corresponding slopes on the hook-like element 15 and/or the snap-in tab 16.

Figure 6:
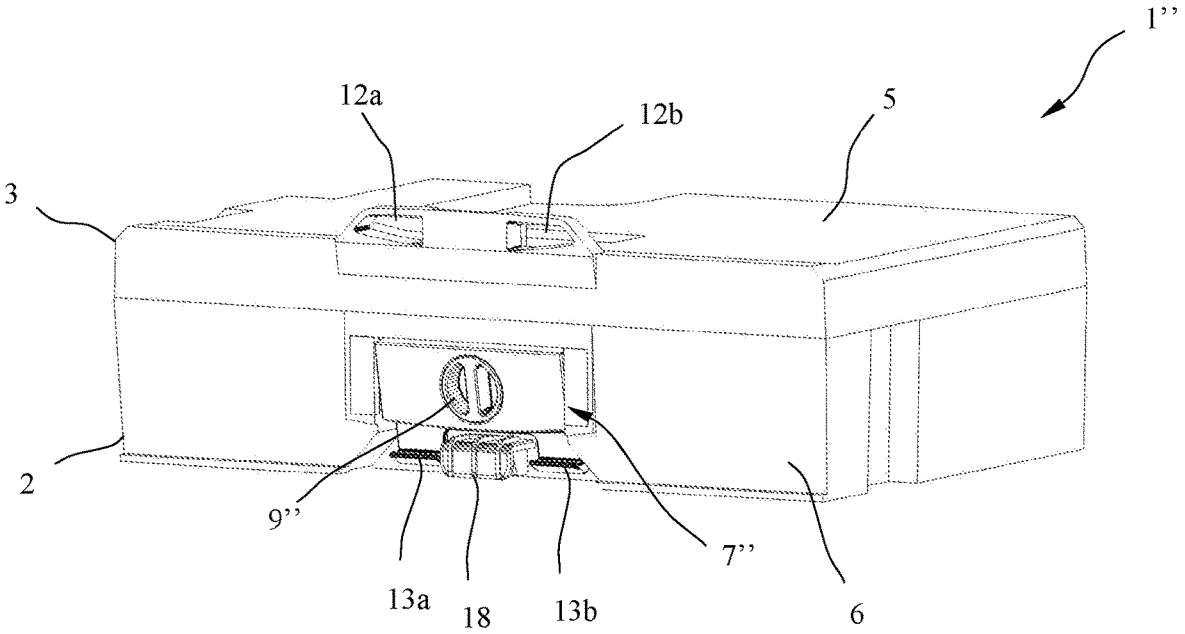
FIG. 6 shows a perspective view of the stackable system container of FIG. 1 in which a coupling device is locked in the rest position by means of a second alternative locking element.

A perspective view of a second alternative embodiment of the stackable system container 1" of FIG. 1 is shown in FIG. 6, in which a coupling device 7" is locked in the rest position by means of a second alternative locking element 9". The second alternative locking element 9", in contrast to the previously described locking elements 9, 9', is designed as a knob. By means of the locking element 9", the coupling device 7" can also be releasably locked in the depicted rest position. Identical features are provided below with the same reference numbers.

Figure 7:
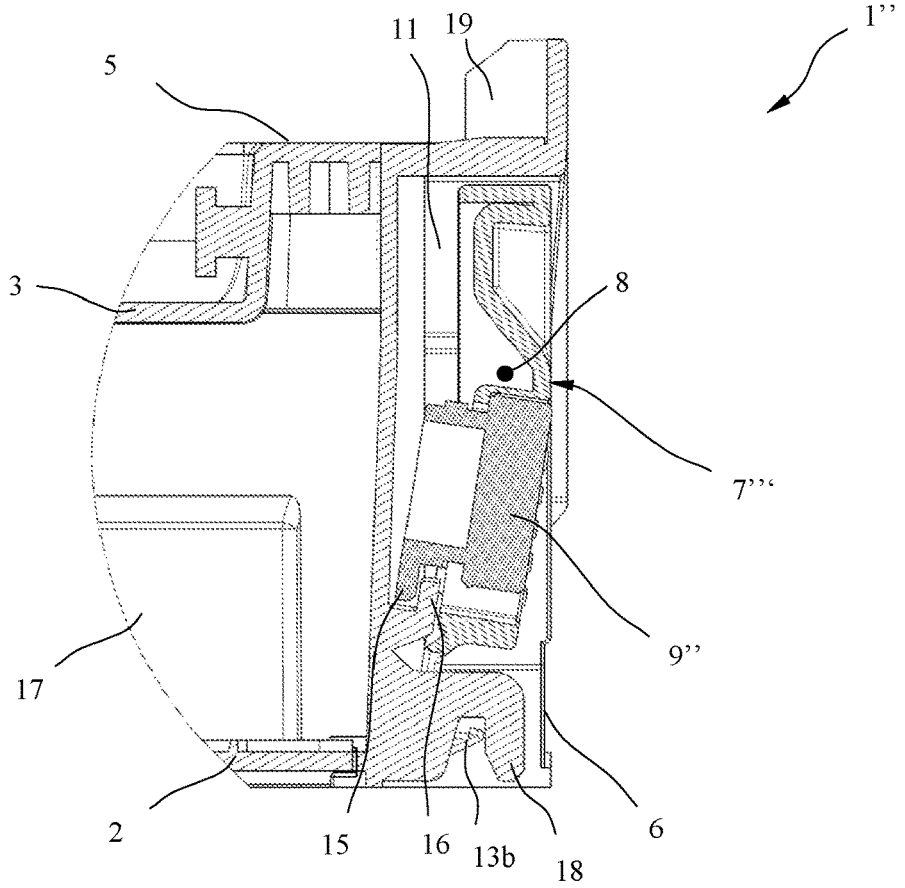
FIG. 7 shows a detail view of a section through the area of the coupling device of FIG. 6.

A detail view of a section through the area of the coupling device 7" of FIG. 6 is shown in FIG. 7. As can be seen, the coupling device 7" is arranged in the pivoted-in rest position, in which the counter-elements 13*a*, 13*b* are pivoted in to the recess 11 away from the side wall 6. The locking element 9" designed as a knob is arranged in a continuous recess 14 in the coupling device 7" and has a hook-like element 15 on a back side that retentively engages behind a snap-in tab 16 arranged on the bottom part 2 and especially in the recess 11 in the depicted locking position of the locking element 9" and therefore keeps the coupling device 7" in the rest position in a shape-mated manner.

A locking element 9" designed as a knob is mounted to rotate in the coupling device 7", in which case the hook-like element 15 protrudes in the radial direction only above part of the periphery of the locking element 9". If the locking element 9" is rotated from the locking position depicted in FIG. 7, the coupling device 7" is released from the pivoted-in rest position, as described below with reference to FIG. 8. The hook-like element 15 can also extend radially outward in sections in the shape of a helix in the peripheral direction of the locking element 9" so that simple mutual engagement and mutual tightening of the locking element 9" with the snap-in tab 16 is achieved.

Figure 8:
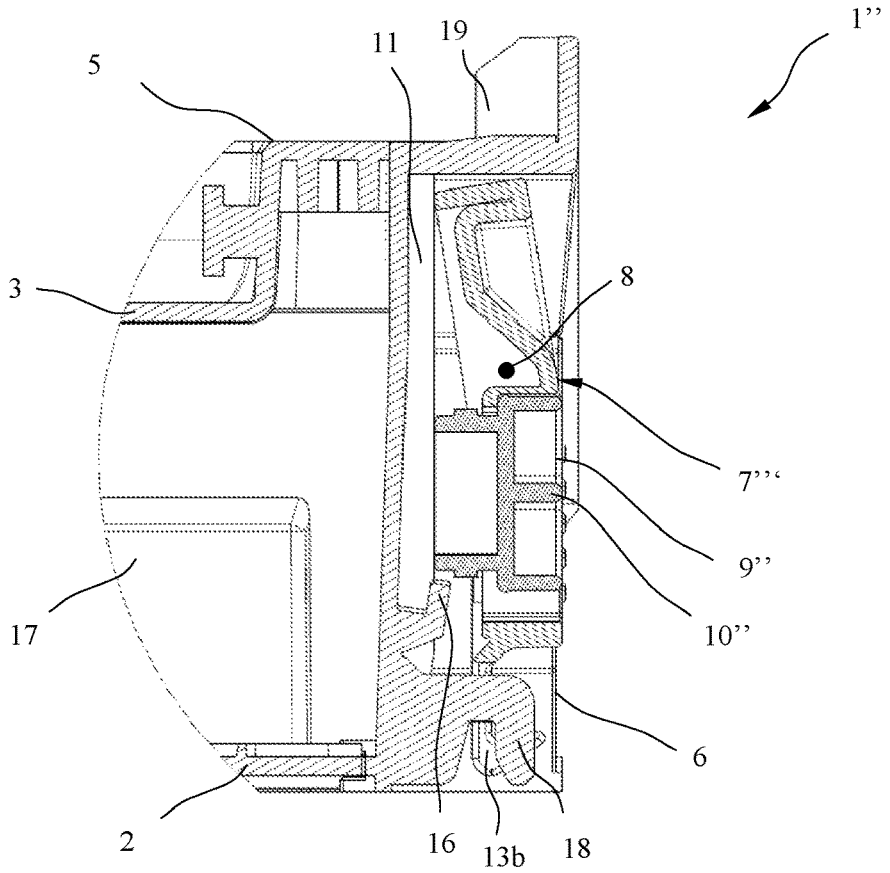
FIG. 8 shows a detail view of a section through the area of the coupling device of FIG. 6 with the coupling device in the coupling position.

A detail view of a section through the area of the coupling device 7" is shown in FIG. 8, in which the coupling device 7" is arranged in the pivoted-out coupling position. The locking element 9" has been rotated from the locking position depicted in FIG. 7 into an opening position, which is made simply possible using the handle section 10". In the depicted position, the hook-like element 15 no longer engages behind the snap-in tab 16 on the locking element 9" on the bottom part so that the coupling device 7" together with the locking element 9" is forced into the coupling position, supported by the spring element (not shown). In the coupling position, the counter-elements 13*a*, 13*b* are also arranged in the direction away from the trough and toward the side surface 6 so that they can retentively protrude into the corresponding coupling elements 12*a*, 12*b* of an identical system container arranged underneath. The rotational position of the locking position and the opening position can be defined by means of corresponding stops between the locking element 9" and the coupling device 7".

A further spring element in the form of a rotary spring can be provided between the locking element 9' and the coupling device 7', which biases the locking element 9' in the locking position or opening position so that automatic opening or locking is made possible alternately during operation of the coupling device 7', if automatic displacement during mutual contact occurs by corresponding slopes on the hook-like element 15 and/or the snap-in tab 16.

The coupling elements 11*a*, 11*b* are formed in the depicted practical examples as pockets or recesses but can also be designed as protrusions. The counter-elements 12*a*, 12*b* are then designed to correspond to the coupling elements 11*a*, 11*b* as pockets or recesses.

In addition to arranging the coupling elements 12*a*, 12*b* vertically above the counter-elements 13*a*, 13*b*, it can also be prescribed in principle that the coupling elements 12*a* or 12*b* be arranged in the plane of rotation of the counter-elements 13*a* to 13*b* around the pivot axis 9. This guarantees that when several identical system containers 1, 1', 1" are positioned precisely one above the other, the counter-elements 13*a*, 13*b* of the upper system container can retentively engage in a shape-mated manner in the coupling elements 12*a*, 12*b* of the lower system container in the coupling position.

In order to achieve locking of the locking elements 9, 9', 9" in the locking and/or opening position, a snap-in device can also be provided, which is designed, for example, as a preferably elastically positioned locking protrusion in the form of a locking ball or a locking landing, which engages retentively in a corresponding locking recess. By means of a defined force, the snap-in device can then be overcome, which prevents the locking element from being released inadvertently.

Figure 9:
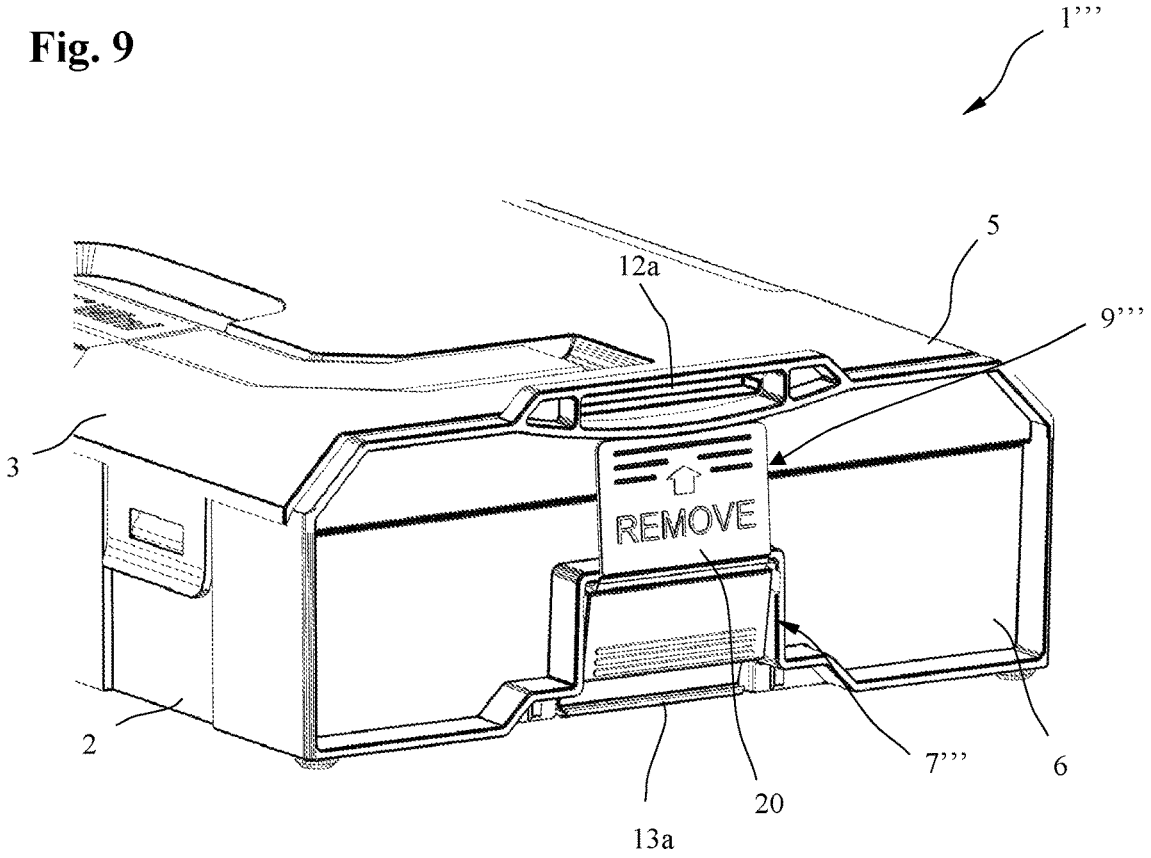
FIG. 9 shows a perspective view of a further stackable system container, in which a coupling device is locked in the rest position by means of a third alternative locking element.

A perspective view of a further stackable system container 1''' is shown in FIG. 9, in which a corresponding coupling device 7''' is locked by means of a third alternative locking element 9''' in the rest position. The locking element 9''' is designed here as a separate component and is pushed into a gap between the coupling gap device 7''' and the bottom part 2 for locking of the coupling device 7''' in the rest position, so that the two components are tightened relative to each other. This permits particularly cost-effective production, because the locking elements 9''' can be designed as simple, preferably wedge-shaped plates and no special additional features need be provided on the system containers. These locking elements 9''' can also be reused precisely in logistics so that additional advantages are obtained. Otherwise, identical components and parts are provided with the same reference numbers. As is apparent, the locking element 9''' has an essentially flat design, in which retaining elements, like landings, grooves or a special coating are provided on a retaining section 20 of the locking element 9''' in order to increase friction and therefore facilitate gripping and loosening of the locking element 9''' from the coupling device 7'''.

Figure 10:
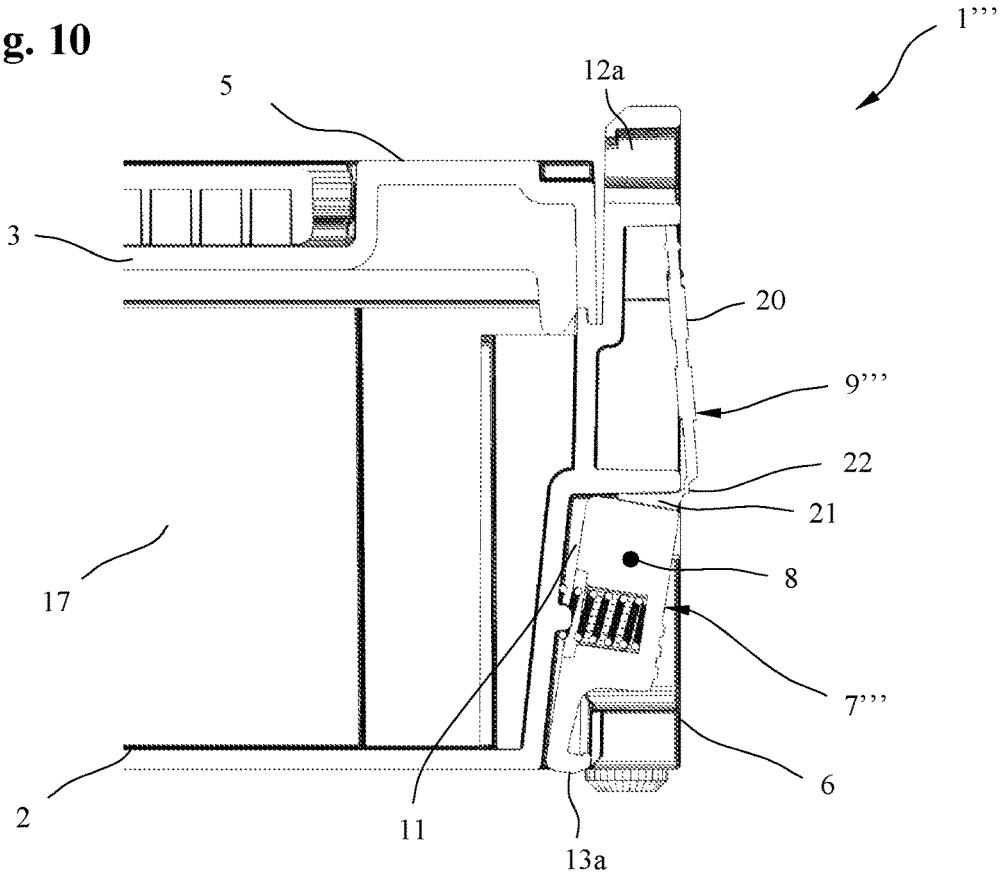
FIG. 10 shows a detail view of a section through the area of the coupling device of FIG. 9 with the coupling device in the rest position.

As follows, in particular from the detail view of a section through the area of the coupling device 7''' of FIG. 9 in FIG. 10, the locking element 9''' has a wedge-like tightening section 21, which is inserted between the bottom part 2, specifically the area of the bottom part 2 in the recess 11, and the coupling device 7''' in the rest position and held there by friction. This tightening section 21 can also have toothlike protrusions, by means of which friction is additionally increased relative to the bottom part 2 and the coupling device 7'''.

Between the retaining section 20 and the tightening section 21, an articulation in the form of a film hinge 22 is provided so that the tightening section 21 can be pivoted relative to the retaining section 20. In the depicted embodiment, the length of the retaining section 20 is adjusted so that it is force-fit on the upper free end against the bottom part 2 and held in position on this account. In addition, the retaining section 20 can also have a contour on the upper free end that is adjusted to the contour of the bottom section 2 on the contact site, for example, a rounding.

For disassembly the retaining section 20 can be released with a slight tensile force from the depicted position and pivoted downward. Through the large-area design of the retaining section 20 and the optionally formed additional retaining elements, the retaining section 20 can be easily grasped and the tightening section 21 withdrawn from engagement in the gap between the bottom section 2 and the coupling device 7'''.

Figure 11:
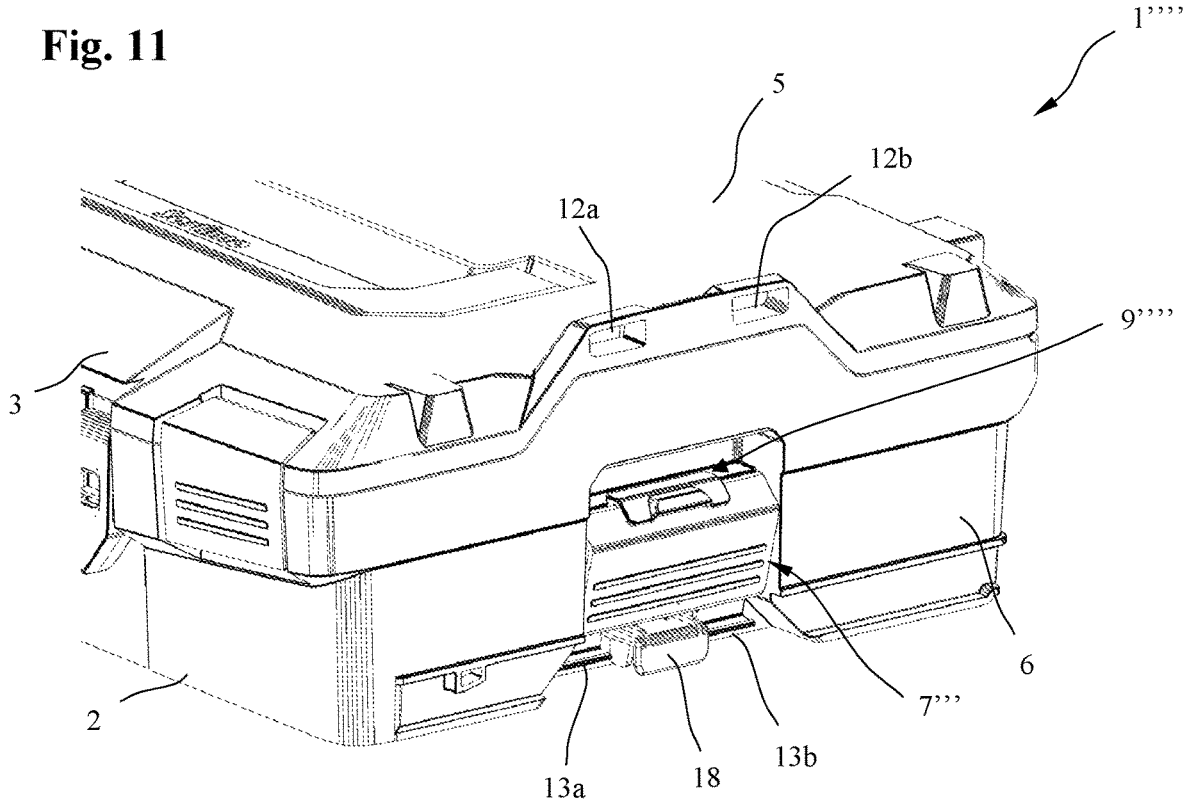
FIG. 11 shows a perspective view of a further stackable system container, in which a coupling device is locked in the rest position by means of a fourth alternative locking element.

A perspective view of a further stackable system container 1'''' is shown in FIG. 11, in which a coupling device 7''' identical to the embodiment in FIG. 9 is locked in the rest position by means of a fifth alternative locking element 9''''.

Figure 12:
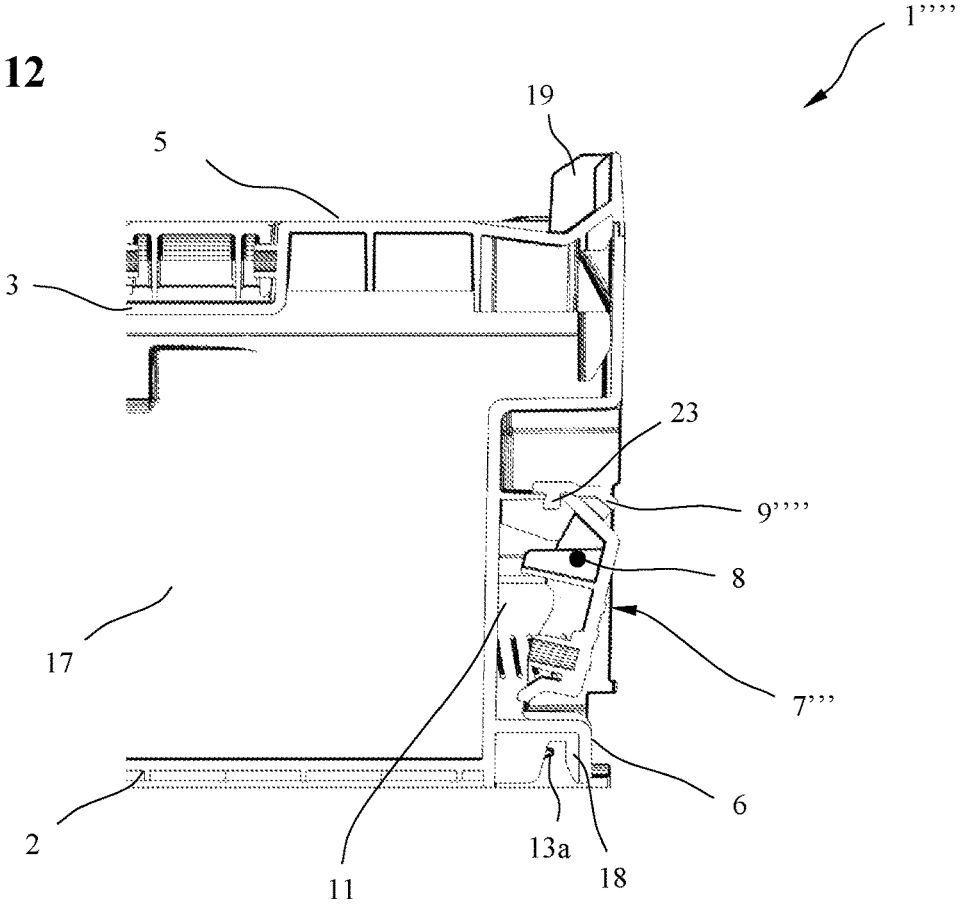
FIG. 12 shows a detail view of a section through the area of the coupling device of FIG. 11 with the coupling device in the rest position.

As can be seen especially from the detail view of the section through the area of the coupling device 7''' of FIG. 11 in FIG. 12, the locking element 9'''' has a laterally protruding protrusion 23, which is positioned between the bottom section 2 and the coupling device 7''' in the recess 11 and in so doing locks the locking element 9'''' in a shape-mated manner in the depicted rest position.

Figure 13:
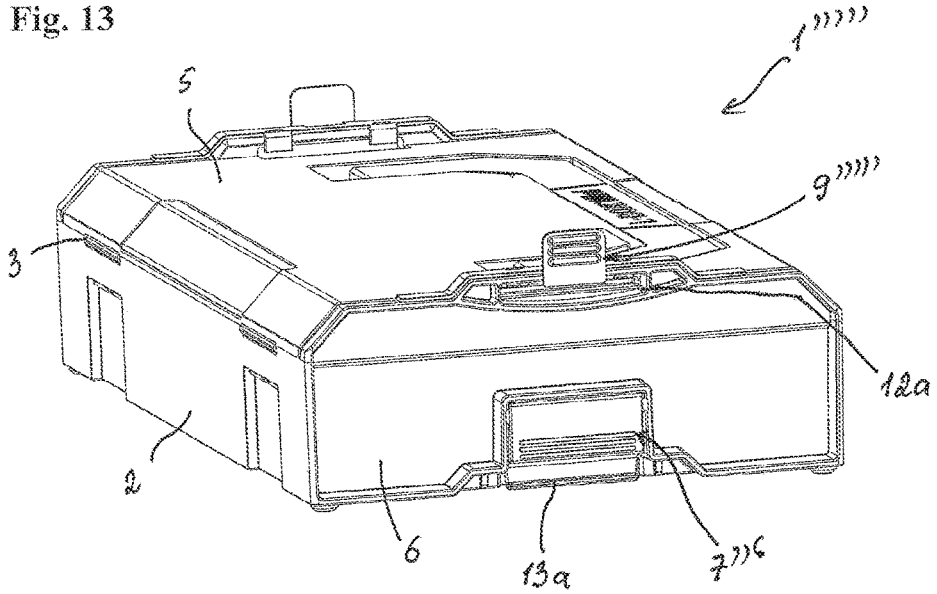
FIG. 13 shows a perspective view of a further stackable system container having a fifth alternative locking element for locking of the coupling device.

A perspective view of a further stackable system container 1'''' with a fifth alternative locking element 9'''' is shown in the stacked state in FIG. 13 for locking of the coupling device 7''' identical to the configuration in FIG. 9. In contrast to the previously described embodiments, however, the locking element 9'''' is positioned on the coupling element 12*a* so that it protrudes upward from the top 5 of the system container 1'''' and also closes off the coupling element 12*a* formed as a pocket.

Figure 14:
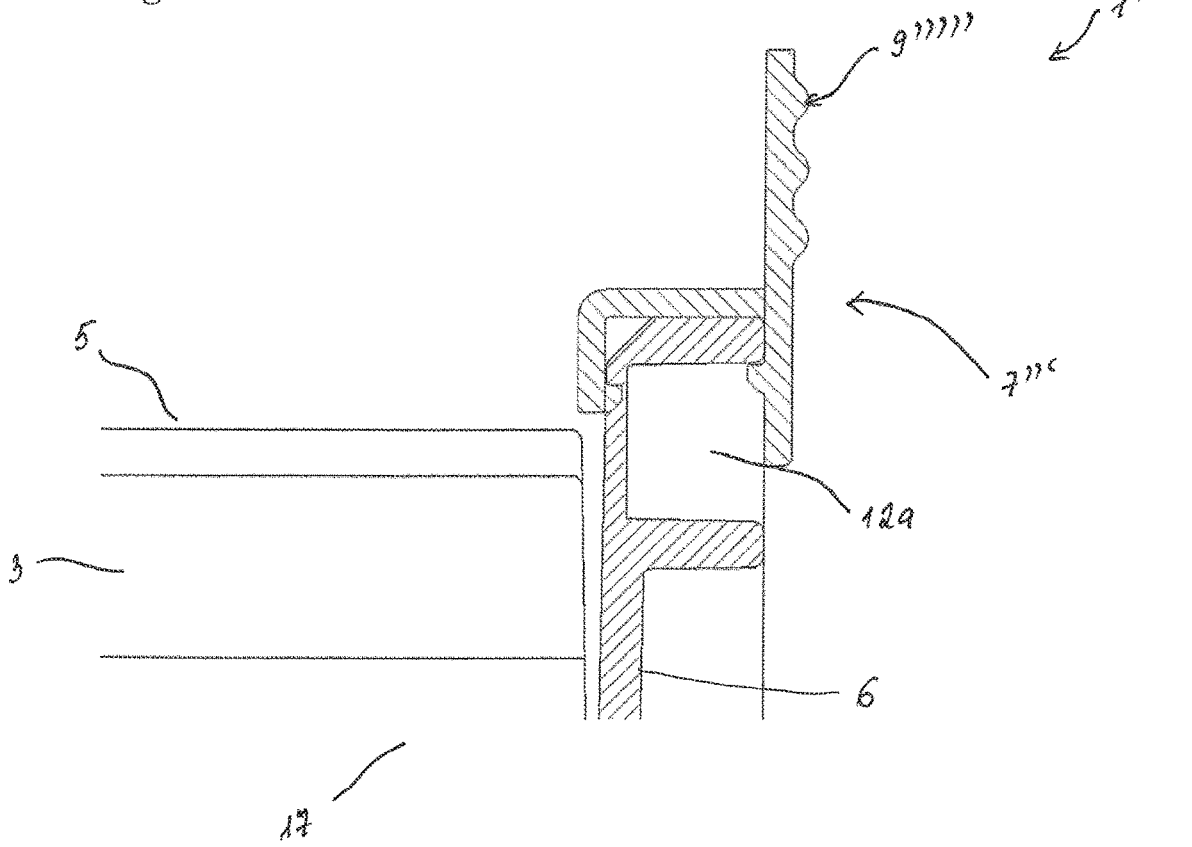
FIG. 14 shows a detail view of a section through the area of the fifth alternative locking element of FIG. 13

As can be seen from the detail view of the section through the area of the fifth alternative locking element 9'''' of FIG. 13 in FIG. 14, the locking element 9'''' therefore forms a spacer for an additionally positioned system container and in a stack of several such system containers prevents engagement of the locking element 9'''' of a system container arranged above it in the coupling element 12*a* of a system container arranged beneath and locks the coupling device 7''' in the rest position.

Figure 15:
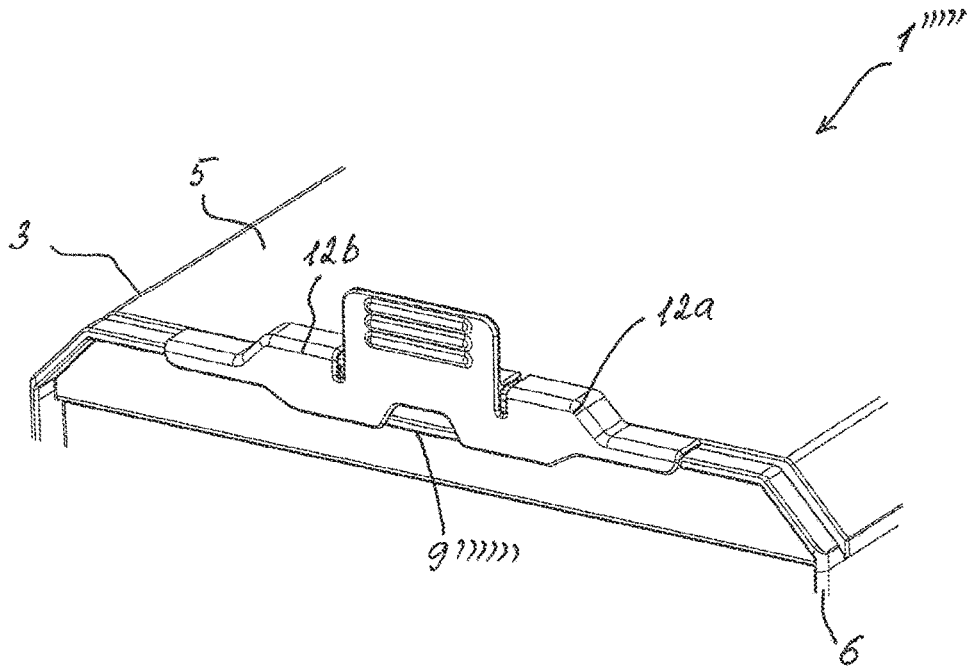
FIG. 15 shows a detail view of a sixth alternative locking element.

A detail view of a sixth alternative locking element 9''''' is shown in FIG. 15, which in contrast to the aforementioned embodiment engages retentively and laterally in the coupling elements 12*a*, 12*b* designed as pockets and is securely fixed on this account.

LIST OF REFERENCE NUMBERS

1, 1', 1'', 1''', 1'''', 1''''' Stackable system container
2 Bottom part
3 Cover part
4 Articulation
5 Top
6 Side wall
7, 7', 7'', 7''', Coupling device
8 Pivot axis
9, 9', 9''; 9''', 9'''', 9''''' Locking element
10, 10', 10'' Handle section
11 Recess
12*a*, 12*b* Coupling element
13*a*, 13*b* Counter-element
14 Recess
15 Hook-like element
16 Snap-in tab
17 Internal space
18 Positioning pin
19 Positioning receptacle
20 Retaining section
21 Tightening section
22 Film hinge

The invention claimed is:

1. A stackable system container having a bottom part, a first coupling device positioned on a first side wall of the bottom part, and a second coupling device positioned on a second side wall of the bottom part, wherein each of the coupling devices is movable between a rest position, in which the respective coupling device is disengaged from a further system container, and a coupling position, in which the respective coupling device engages with the further system container, wherein the first coupling device is operatively associated with a first locking element that releasably locks the first coupling device in the rest position and the second coupling device is operatively associated with a second locking element that releasably locks the second coupling device in the rest position, and wherein each of the locking elements is designed as a slide, which in a locking position keeps the corresponding coupling device in the rest position in shape-mated fashion.

2. The stackable system container according to claim 1, wherein a first spring element is provided that forces the first coupling device into the coupling position.

3. The stackable system container according to claim 1, wherein each of the locking elements is fastened movably to a bottom portion of the corresponding coupling device.

4. The stackable system container according to claim 3, wherein a first snap-in tab is provided on the first side wall, and wherein the first snap-in tab can be retentively engaged by the first locking element in the locking position.

5. The stackable system container according to claim 1, wherein the coupling devices are fastened to the corresponding side wall pivotable between the pivoted-in rest position and the pivoted-out coupling position.

6. The stackable system container according to claim 1, wherein each coupling device can be pivoted around a pivot axis parallel to the corresponding side wall.

7. The stackable system container according to claim 1, wherein the side walls each have a recess in which the corresponding coupling devices are arranged.

8. A stackable system container having a bottom part, a first coupling device positioned on a first side wall of the bottom part, and a second coupling device positioned on a second side wall of the bottom part, wherein each of the coupling devices is movable between a rest position, in which the respective coupling device is disengaged from a further system container, and a coupling position, in which the respective coupling device engages with the further system container, wherein the first coupling device is operatively associated with a first locking element that releasably locks the first coupling device in the rest position and the second coupling device is operatively associated with a second locking element that releasably locks the second coupling device in the rest position, and wherein upward protruding coupling elements, which are arranged on the bottom part or a cover part of the system container, are designed to retentively cooperate with the coupling devices of an identical system container arranged above the system container.

9. The stackable system container according to claim 8, wherein in the vertical direction beneath each coupling device a corresponding counter-element is arranged on the corresponding coupling device.

10. The stackable system container according to claim 7, wherein each of the recesses is dimensioned so that the corresponding coupling device does not protrude outward beyond the corresponding side wall in coupling position.

11. A stackable system container having a bottom part, a first coupling device positioned on a first side wall of the bottom part, and a second coupling device positioned on a second side wall of the bottom part, wherein each of the coupling devices is movable between a rest position, in which the respective coupling device is disengaged from a further system container, and a coupling position, in which the respective coupling device engages with the further system container, wherein the first coupling device is operatively associated with a first locking element that releasably locks the first coupling device in the rest position and the second coupling device is operatively associated with a second locking element that releasably locks the second coupling device in the rest position, wherein a first spring element is provided that forces the first coupling device into the coupling position, wherein a second spring element is provided that forces the second coupling device into the coupling position, wherein each of the locking elements is designed as a slide, which in a locking position keeps the corresponding coupling device in the rest position in shape-mated fashion, and wherein each of the slides includes a handle protruding from the corresponding side wall, which can be grasped for operation of the corresponding locking element.

* * * * *